US009989291B2

(12) United States Patent
Kuroda

(10) Patent No.: US 9,989,291 B2
(45) Date of Patent: Jun. 5, 2018

(54) ICE MACHINE DISCHARGE ASSEMBLY RATCHET STRUCTURE

(71) Applicant: NIDEC SERVO CORPORATION, Kiryu-shi, Gumma (JP)

(72) Inventor: Eiji Kuroda, Kiryu (JP)

(73) Assignee: NIDEC SERVO CORPORATION, Gunma (JP)

( * ) Notice: Subject to any disclaimer, the term of this patent is extended or adjusted under 35 U.S.C. 154(b) by 253 days.

(21) Appl. No.: 14/797,420

(22) Filed: Jul. 13, 2015

(65) Prior Publication Data

US 2016/0010911 A1 Jan. 14, 2016

Related U.S. Application Data

(60) Provisional application No. 62/024,068, filed on Jul. 14, 2014.

(51) Int. Cl.

| | |
|---|---|
| ***F25C 5/00*** | (2018.01) |
| ***F25C 1/04*** | (2018.01) |
| ***F25C 5/04*** | (2006.01) |

(52) U.S. Cl.
CPC . *F25C 1/04* (2013.01); *F25C 5/04* (2013.01)

(58) Field of Classification Search
CPC .. F25C 1/04; F25C 5/005; F16D 7/044; F16F 1/32; F16F 1/328; F16F 1/34
See application file for complete search history.

(56) References Cited

U.S. PATENT DOCUMENTS

| | | | | |
|---|---|---|---|---|
| 3,247,682 | A * | 4/1966 | Jacobs | F25C 1/10 62/344 |
| 4,800,731 | A * | 1/1989 | Cole | F25C 1/04 62/233 |
| 6,254,071 | B1 * | 7/2001 | Greenhill | F16F 1/025 267/158 |
| 7,669,496 | B2 * | 3/2010 | Takahashi | F16D 7/044 192/46 |
| 2007/0199635 | A1 | 8/2007 | McCauley et al. | |
| 2014/0290300 | A1 * | 10/2014 | Jeong | F25C 5/007 62/344 |

FOREIGN PATENT DOCUMENTS

| | | |
|---|---|---|
| JP | 10-142996 A | 5/1998 |
| JP | 2001-179650 A | 7/2001 |
| JP | 2002-122118 A | 4/2002 |
| JP | 2008-014104 A | 1/2008 |

* cited by examiner

*Primary Examiner* — Christopher R Zerphey
(74) *Attorney, Agent, or Firm* — Keating & Bennett, LLP

(57) ABSTRACT

An ice machine includes an ice discharge gear to which an output of a motor is transmitted. The ice discharge gear is configured to rotate about a rotation axis, a cam member is disposed at a first axial side of the ice discharge gear and provided with a ratchet structure between the cam member and the ice discharge gear, and an ice discharge shaft is connected to the cam member in a facing relationship with the cam member and configured to scrape out ice pieces with ice discharge claw portions during rotation of the ice discharge shaft. A flat or substantially flat sleeve is disposed at a second axial side of the ice discharge gear so as to face the ice discharge gear across a gap, and an elastic member is interposed between the sleeve and the ice discharge gear.

3 Claims, 3 Drawing Sheets

ICE MACHINE DISCHARGE ASSEMBLY RATCHET STRUCTURE

BACKGROUND OF THE INVENTION

1. Field of the Invention

The present invention relates to an ice machine mounted to a refrigerator.

2. Description of the Related Art

In a conventional ice machine, a gear for transmitting an output from a motor and a cam disposed in a coaxial relationship with the gear are connected by a ratchet mechanism for transmitting power. The ratchet mechanism is connected by receiving a preload from a coil spring, to transmit power.

However, in the conventional coaxial ratchet mechanism, the coil spring for applying a preload to the ratchet mechanism is not configured to rotate together with the ratchet mechanism. For that reason, if the ratchet mechanism is continuously used, a deviation may be generated between the rotation center of the ratchet mechanism and the center of the coil spring. Thus, there is a possibility that the pressing force applied by a preload becomes unstable.

SUMMARY OF THE INVENTION

In accordance with a preferred embodiment of the present invention, an ice machine which is able to be mounted to a refrigerator includes: an ice discharge gear to which an output of a motor is transmitted, the ice discharge gear configured to rotate about a rotation axis; a cam member disposed at a first axial side of the ice discharge gear in a coaxial relationship with the ice discharge gear and provided with a ratchet structure between the cam member and the ice discharge gear; and an ice discharge shaft connected to the cam member in a facing relationship with the cam member and configured to scrape out ice pieces with ice discharge claw portions during rotation of the ice discharge shaft, wherein a flat or substantially flat sleeve is disposed at another axial side of the ice discharge gear so as to face the ice discharge gear across a gap, and an elastic member is interposed between the sleeve and the ice discharge gear.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
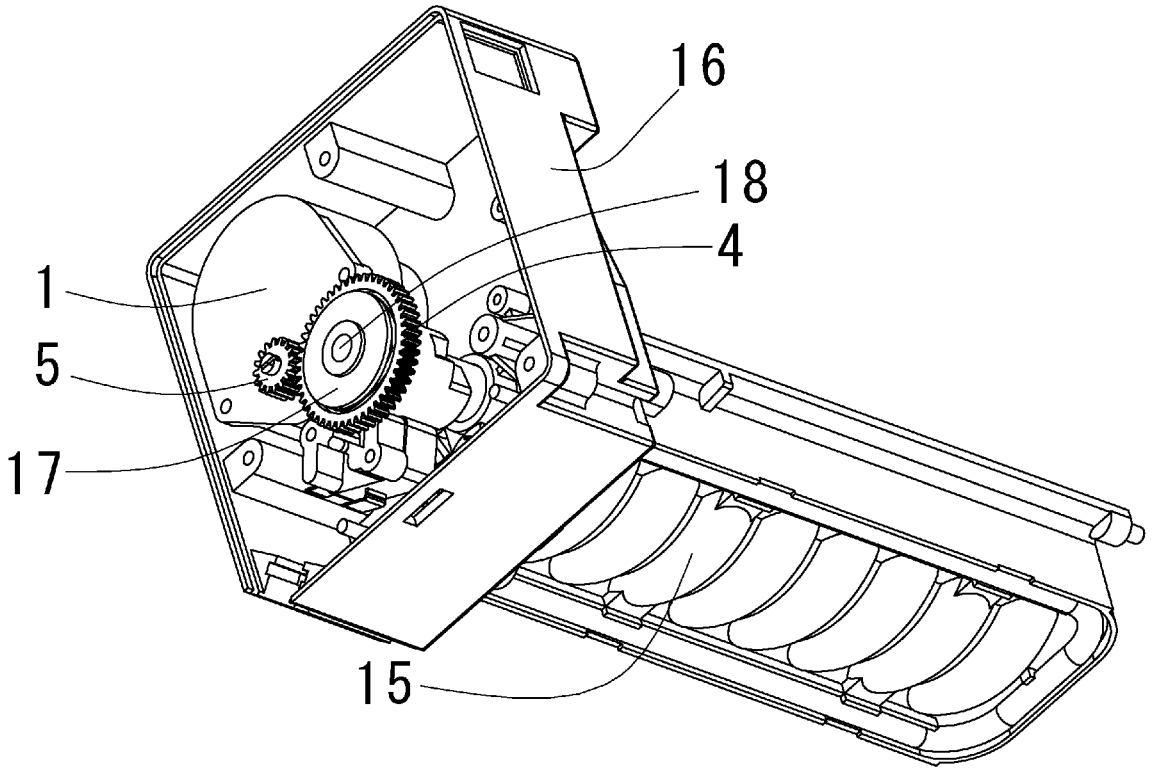
FIG. 1 is a perspective view of a mechanical assembly of an ice machine according to a preferred embodiment of the present invention.
Figure 2:
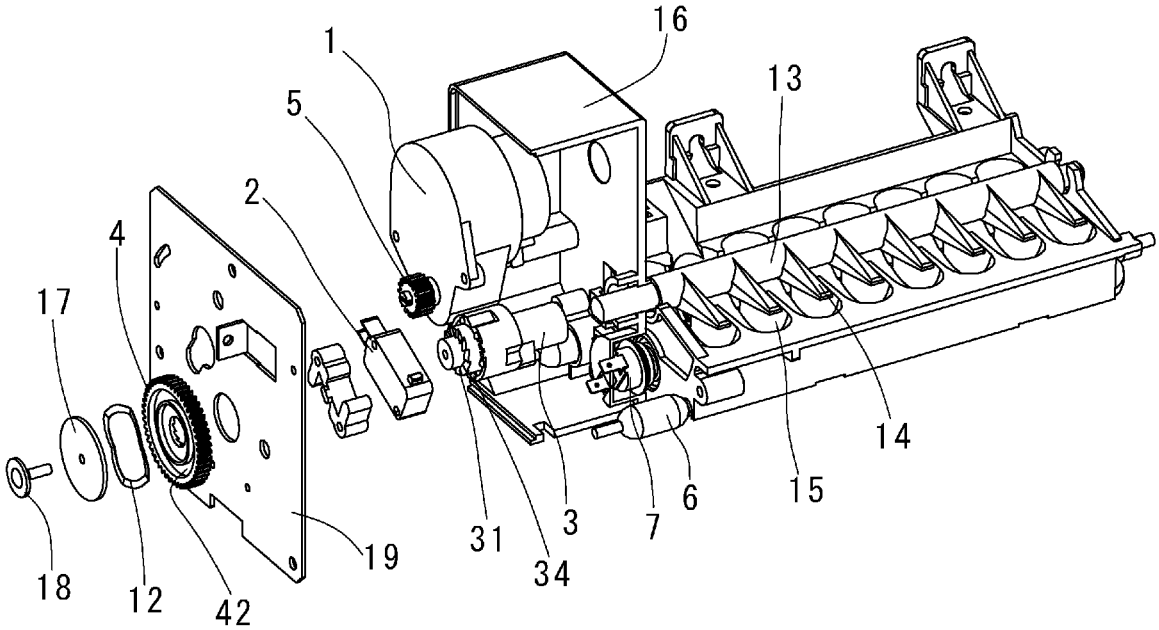
FIG. 2 is an exploded perspective view of the ice machine according to a preferred embodiment of the present invention.
Figure 3:
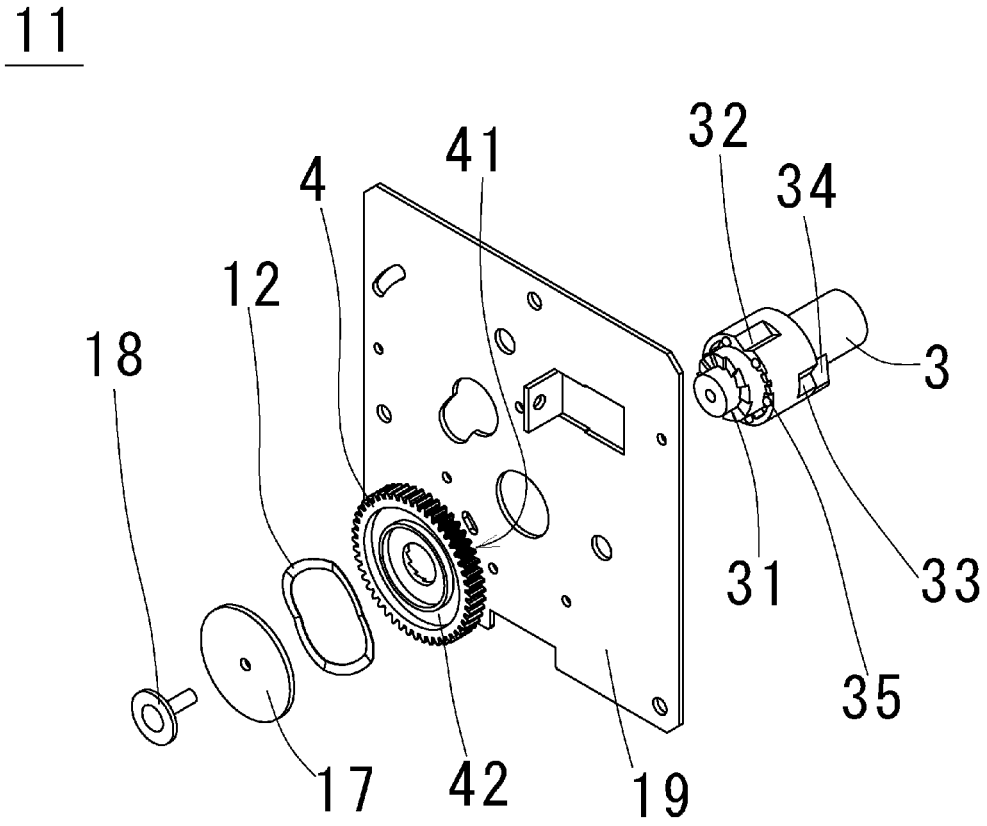
FIG. 3 is an exploded perspective view of a ratchet mechanism according to a preferred embodiment of the present invention.

FIGS. 1 to 3 are views illustrating one example configuration of an ice machine according to one preferred embodiment of the present invention. FIG. 1 is a perspective view of a mechanical assembly of an ice machine. An attachment plate is not shown in order to make the internal structure readily understandable. FIG. 2 is an exploded perspective view of the ice machine, illustrating a state in which the respective parts defining the ice machine are exploded in the axial direction. FIG. 3 is an exploded perspective view of a ratchet mechanism according to a preferred embodiment of the present invention, illustrating a state in which the respective parts are exploded in the direction of an ice discharge shaft of the ice machine.

In the ice machine, ice pieces generated within an ice tray 15 are discharged using a motor assembly 1. The ice machine preferably includes the motor assembly 1, a micro switch 2, a cam member 3, an ice discharge gear 4, a motor gear 5, a heater 6, a thermostat 7, a full-ice detection switch (not illustrated), a water switch (not illustrated), a water valve (not illustrated), a ratchet mechanism 11, a ratchet preloading spring 12, an ice discharge shaft 13, ice discharge claw portions 14, an ice tray 15, a case 16, a sleeve 17, a screw 18, and an attachment plate 19.

The ice machine will be described with reference to FIGS. 1 and 2. In the following descriptions, the direction of an imaginary axis parallel or substantially parallel to the ice discharge shaft 13 will be defined as an axial direction. The side at which the cam member 3 is mounted to the ice discharge shaft 13 will be defined as a first axial side (the left side in FIG. 2). The opposite side will be defined as a second axial side (the right side in FIG. 2).

The case 16 is preferably box-shaped or substantially box-shaped with an axial side thereof opened. The attachment plate 19 has a flat or substantially flat plate shape and includes a plurality of openings defined in the axial direction. The attachment plate 19 closes the opening of the case 16 provided at an axial side. A box-shaped space is defined by the case 16 and the attachment plate 19. The motor assembly 1, the micro switch 2, the cam member 3, the heater 6, the thermostat 7 and the water switch (not illustrated) are all preferably accommodated within the space. The ice discharge gear 4, the motor gear 5, the ratchet preloading spring 12, the sleeve 17 and the screw 18 are preferably disposed at a first axial side of the attachment plate 19. The ice discharge claw portions 14 and the ice tray 15 are preferably disposed at a second axial side of the case 16. The ice discharge shaft 13 extends from a first axial side of the attachment plate 19 to the second axial side of the case 16.

The motor assembly 1 and the micro switch 2 are fixed to the attachment plate 19. The thermostat 7 and the ice tray 15 are fixed to the case 16.

The motor assembly 1 preferably includes a motor and a speed reducer. The output shaft of the motor assembly 1 protrudes from the second axial side of the attachment plate 19 toward the first axial side thereof. The motor gear 5 fixed to the output shaft of the motor assembly 1 is disposed so as to engage with the ice discharge gear 4. By the engagement of the motor gear 5 and the ice discharge gear 4, the torque of the motor assembly 1 is transmitted to the ice discharge gear 4. The ice discharge gear 4 and the cam member 3 define a portion of the ratchet mechanism 11 which will be described later. The ice discharge shaft 13, which is preferably provided as a single monolithic member together with the ice discharge claw portions 14, is fixed to the cam member 3. The ice discharge gear 4 and the cam member 3 are brought into engagement with each other by the axial biasing action of the ratchet preloading spring 12, which will be described later. Thus, the ice discharge gear 4 and the cam member 3 define the ratchet mechanism 11 such that the torque is transmitted from the motor assembly 1 to the ice discharge shaft 13. The output shaft of the motor assembly 1, the ice discharge gear 4, and the motor gear 5 rotate about respective axes parallel or substantially parallel to the axial direction. The rotation of the motor is on/off controlled by, for example, the cam member 3, the micro switch 2, the thermostat 7, the full-ice detection switch, etc. The motor is rotated in one direction by external electric power. In the present preferred embodiment, the rotation direction of the motor remains unchanged. That is, the motor preferably does not rotate in the reverse direction.

The motor gear 5 is preferably made of, e.g., a resin and is fixed to the output shaft of the motor assembly 1 by, for example, press-fitting, adhesives, fasteners, etc. The motor gear 5 is preferably a spur gear. The axial length of the motor gear 5 is set such that the ice discharge gear 4 does not disengage with the motor gear 5 even when the ice discharge gear 4 is moved in the thrust direction. That is to say, the axial length of the motor gear 5 is larger than the axial movement amount of the ice discharge gear 4.

The ice discharge gear 4 is preferably made of, e.g., a resin. Teeth engaging with the motor gear 5 are provided on the outer circumferential surface of the ice discharge gear 4. Serrated teeth which define a portion of the ratchet mechanism 11 are provided on one axial surface of the ice discharge gear 4. A grove 42 configured to accommodate at least a portion of the ratchet preloading spring 12, which will be described later, is provided on one axial surface of the ice discharge gear 4. The cam member 3 is inserted into the radial inner side of the ice discharge gear 4. The inner circumferential surface of the ice discharge gear 4 contacts the outer circumferential surface of the cam member 3 in a relatively rotatable state. With the configuration described above, the ice discharge gear 4 is used to engage with the motor gear 5 and secure concentricity with the ratchet mechanism 11. In the case where the ice discharge gear 4 is rotated by an external force, it is highly likely that at least one of the ice discharge gear 4, the motor gear 5 and the speed reducer of the motor assembly 1 will be broken.

The cam member 3 is preferably made of, e.g., a resin material. The cam member 3 includes a cylindrical outer circumferential surface. Descriptions will be made later on the shape of the cam member 3. A recess portion, to which the ice discharge shaft 13 is fitted, is defined inside the cam member 3. The cam member 3 transmits a torque from the ice discharge gear 4 to the ice discharge shaft 13 via the ratchet mechanism 11.

The ice discharge claw portions 14 are fixed to the ice discharge shaft 13. The ice discharge claw portions 14 are preferably made of, e.g., a resin material. During an ice discharge operation, the ice discharge shaft 13 and the ice discharge claw portions 14 are rotated by the torque transmitted from the cam member 3. The ice discharge claw portions 14 press the ice pieces existing within the ice tray 15 to discharge the ice pieces.

When the ice discharge operation is not performed, the ice discharge shaft 13 and the ice discharge claw portions 14 are stopped in standby positions. When the ice discharge shaft 13 and the ice discharge claw portions 14 are stopped in the standby positions, the ice tray 15 and the ice discharge claw portions 14 are preferably parallel or substantially parallel to each other. However, the positional relationship between the ice tray 15 and the ice discharge claw portions 14 in the standby position is not limited thereto. If the ice discharge operation is started, the ice discharge shaft 13 and the ice discharge claw portions 14 are rotated by the motor gear 5 mounted to the output shaft of the motor assembly 1, the ice discharge gear 4, the ratchet mechanism 11, and the cam member 3 to discharge the ice pieces.

A plurality of grooves and/or projections are provided on the outer circumferential surface of the cam member 3. The cam member 3 preferably performs not only the torque transmitting operation but also the on/off operations of the respective switches.

Referring to FIG. 3, the cam member 3 preferably includes a V-shaped groove 32 defined on the outer circumferential surface thereof. As the cam member 3 rotates, the V-shaped groove 32 turns the micro switch 2 on or off. By the on/off operation of the micro switch 2, the startup or stop of the motor is performed. If the motor is rotated and the ice discharge claw portions 14 are moved to the standby position, the micro switch 2 is operated by the V-shaped groove 32 such that the motor of the motor assembly 1 is stopped.

The thermostat 7 detects the temperature of the ice tray 15. The temperature of the ice tray 15 changes depending on the temperature of water or ice pieces held in the ice tray 15. Water is cooled within a freezer and is frozen into ice pieces at a temperature of about 0° C. If almost all of the water is frozen into ice pieces, the temperature of the ice pieces decreases. The temperature of the ice tray 15 also decreases in conformity with the temperature of the ice pieces. If the temperature of the ice tray 15 becomes lower than the temperature predetermined by the thermostat 7, the motor is started up. If the motor rotates, a torque is transmitted from the motor assembly 1 to the ice discharge claw portions 14 via the motor gear 5, the ice discharge gear 4, the cam member 3 and the ice discharge shaft 13. Thus, the ice discharge claw portions 14 scrape out the ice pieces placed within the ice tray 15. The ice pieces thus scraped fall down into a container (not illustrated).

If the motor rotates further, a groove 33 defined on the outer circumferential surface of the cam member 3 turns the water switch on. Then, the water valve is opened by the water switch to supply water into the ice tray 15. If the motor rotates even further, the water switch is turned off and the water valve is closed.

If the motor continues to rotate, a projection 34 defined on the outer circumferential surface of the cam member 3 operates the full-ice detection switch to detect the amount of the ice pieces accommodated within the aforementioned container. If the motor rotates yet even further, the micro switch 2 is operated by the groove 33 defined on the outer circumferential surface of the cam member 3. The micro switch 2 cuts off the power supply to the motor. Thus, the motor is stopped. In the present preferred embodiment, the time taken from the startup of the motor to the stop thereof may preferably be, e.g., about 2 minutes to about 5 minutes.

If the amount of the ice pieces reaches a predetermined amount, the full-ice detection switch stops power supply to the motor of the motor assembly 1 so that the ice discharge operation is not performed.

When the ice discharge operation is not performed, the ice discharge shaft 13 and the ice discharge claw portions 14 are stopped in the standby positions. If the temperature of the ice tray 15 decreases together with the temperature of the ice pieces, the thermostat 7 drives the motor of the motor assembly 1 to perform an ice discharge operation. If the ice pieces are dropped from the ice tray 15, water is supplied to the ice tray 15. If the ice discharge operation is completed and if the ice discharge shaft 13 and the ice discharge claw portions 14 are moved to the standby positions, the micro switch 2 is operated by the cam member 3 such that the motor is stopped. By repeating the above-described procedures, the ice machine continues to make ice pieces until the amount of the ice pieces reaches a predetermined amount.

Referring to FIG. 3, the ratchet mechanism 11 is provided between the ice discharge gear 4 and the cam member 3. Serrated teeth which are repeatedly depressed and raised in the axial direction are provided annularly on the surface of the ice discharge gear 4 which faces the cam member 3 and which is orthogonal or substantially orthogonal to the center axis. The serrated teeth define an axial gear 41. Furthermore, serrated teeth which are repeatedly depressed and raised in the axial direction are provided annularly on the surface of the cam member 3 which faces the ice discharge gear 4 and which is orthogonal or substantially orthogonal to the center axis. The serrated teeth define an axial gear 31. The ratchet preloading spring 12 is preferably a so-called wave washer and is defined by a ring-shaped or substantially ring-shaped flat member axially waving along the circumferential direction. In other words, the ratchet preloading spring 12 is an elastic member which has an annular or substantially annular shape and has an axially depressed/raised shape when seen in the radial direction. The sleeve 17 is preferably a disc-shaped member made of, e.g., a resin material. The screw 18 is tightened to a screw hole opened toward the first axial side from the rotation center of the cam member 3. The sleeve 17 is fixed to the ice discharge shaft 13 through the screw 18. The sleeve 17 contacts the ratchet preloading spring 12 on the other axial surface thereof.

One axial surface of the ratchet preloading spring 12 contacts the ice discharge gear 4. More specifically, a ring-shaped groove 42 depressed toward the second axial side is provided on one axial surface of the ice discharge gear 4. The ratchet preloading spring 12 is partially accommodated within the groove 42. A second axial surface of the ratchet preloading spring 12 contacts the sleeve 17. Thus, the ratchet preloading spring 12 receives an axial force from the ice discharge gear 4 and the sleeve 17 such that an axially-contracting deformation force is applied to the ratchet preloading spring 12. By the restoring force of the ratchet preloading spring 12, the axial gear 31 of the cam member 3 is biased toward the second axial side. The axial gear 31 of the cam member 3 engages with the axial gear 41 of the ice discharge gear 4. When the ice discharge gear 4 is rotated toward the smooth surfaces of the serrated teeth, the ratchet mechanism 11 is configured to compress the ratchet preloading spring 12 to change the engaging location in the rotation direction. In the case where the ice discharge gear 4 is rotated in the reverse direction, the axial gear 41 of the ice discharge gear 4 engages with the axial gear 31 of the cam member 3 to transmit a torque to the cam member 3 and the ice discharge shaft 13.

The ice discharge gear 4 and the cam member 3 face each other with the attachment plate 19 interposed therebetween. The cam member 3 is positioned within the through-hole defined in the attachment plate 19, thus performing torque delivery. Hemispherical protrusion portions 35 which protrude toward the first axial side are defined at an axial side of the cam member 3 in a region which is radially outward of the axial gear 31. During the rotation of the ice discharge shaft 13, the protrusion portions 35 rotate while contacting the attachment plate 19. Since the protrusion portions 35 are defined in a hemispherical shape, the protrusion portions 35 make point-to-point contact with the attachment plate 19. This makes it possible to reduce a frictional resistance. As a result, the axial gear 31 of the cam member 3 reliably protrudes toward the first axial side of the attachment plate 19.

During a normal use, the ice discharge gear 4, the cam member 3, the ice discharge shaft 13, the ratchet preloading spring 12, the sleeve 17, and the screw 18 are kept in a stationary state and do not move relative to one another. During a ratchet operation, the ice discharge gear 4, the ratchet preloading spring 12, and the sleeve 17 are kept in a stationary state. The rotation direction positions are changed between the cam member 3, the ice discharge shaft 13, and the screw 18.

The ratchet preloading spring 12 is preferably a so-called wave washer. That is to say, the ratchet preloading spring 12 contacts the ice discharge gear 4 at a plurality of circumferentially-spaced apart points. The ratchet preloading spring 12 contacts the sleeve 17 at a plurality of circumferentially-spaced apart points. Therefore, as compared with a case where a coil spring is used, it is possible to apply a uniform force in the circumferential direction. As a result, when the ratchet mechanism 11 performs its function, the axis of the ice discharge gear 4 is hardly deviated from the axis of the cam member 3. Consequently, a torque is stably transmitted between the ice discharge gear 4 and the cam member 3.

During the inspection in a manufacturing process, the maintenance and the check, it is necessary to rotate the ice discharge claw portions 14 under a normal temperature. In this case, a dedicated switch is needed in order to operate the motor. That is to say, if the ice discharge shaft 13 and the ice discharge claw portions 14 are reversely rotated by an external force such as a manual force or the like, there is a fear that the speed reducer of the motor assembly 1 will be broken. Particularly, if the motor is rotated by an external force when the reduction ratio of the speed reducer is large, it is highly likely that the speed reducer of the motor assembly 1 will be broken. Further, if the motor exerts a large detent torque, it is highly likely that the speed reducer of the motor assembly 1 will be broken. In contrast, according to various preferred embodiments of the present invention, it is possible to directly rotate the ice discharge claw portions 14 using the hand or the like. That is to say, even if the ice discharge shaft 13 is reversely rotated, the rotation of the ice discharge shaft 13 is not transmitted to the motor assembly 1 due to the action of the ratchet mechanism 11 and any breaking of components is prevented. For that reason, a dedicated switch configured to rotate the ice discharge claw portions 14 under a normal temperature is unnecessary. Furthermore, by rotating the cam member 3 which is integrally provided with the ice discharge shaft 13 (either as a single monolithic member or as integrally attached portions) and moving the ice discharge shaft 13 away from the standby position, it is possible to operate the micro switch 2 and to operate the motor of the motor assembly 1.

The present invention is not limited to the above-described preferred embodiments and may be applied to a variety of preferred embodiments.

Features of the above-described preferred embodiments and the modifications thereof may be combined appropriately as long as no conflict arises.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An ice machine which can be mounted to a refrigerator, comprising:

an ice discharge gear configured to receive an output of a motor and to rotate about a rotation axis;

a cam member disposed at a first axial side of the ice discharge gear in a coaxial relationship with the ice discharge gear and provided with a ratchet structure between the cam member and the ice discharge gear; and an ice discharge shaft connected to the cam member in a facing relationship with the cam member and configured to scrape out ice pieces with ice discharge claw portions during rotation of the ice discharge shaft;

a motor gear fixed to the motor and positioned to engage with the ice discharge gear; and a case configured to accommodate the motor and the cam member; wherein a flat or substantially flat sleeve is disposed at a second axial side of the ice discharge gear so as to face the ice discharge gear across a gap;

an elastic member is interposed between the sleeve and the ice discharge gear;

the ice discharge gear includes a ring-shaped groove defined on the second axial side of the ice discharge gear and depressed toward the first axial side, and the elastic member is at least partially accommodated within the groove; and the motor gear and the ice discharge gear are disposed at a second axial side of the case such that an entirety of the case is axially between (i) the ice discharge shaft and (ii) the motor gear and the ice discharge gear.

2. The ice machine of claim 1, wherein the ring-shaped groove is disposed to be co-axial with the rotation axis of the ice discharge gear; and the elastic member applies a uniform force in a circumferential direction of the ice discharge gear due to the ring-shaped groove being co-axial with the rotation axis of the ice discharge gear.

3. The ice machine of claim 1, further comprising:

a cylindrical projection provided on the ice discharge gear at a position spaced radially outward from the rotation axis of the ice discharge gear to define a radially innermost edge of the ring-shaped groove.

* * * * *